US010909828B2

(12) United States Patent
Barson et al.

(10) Patent No.: US 10,909,828 B2
(45) Date of Patent: Feb. 2, 2021

(54) ALARM DEVICE FOR A FIRE ALARM SYSTEM

(71) Applicant: Honeywell International Inc., Morris Plains, NJ (US)

(72) Inventors: Michael Barson, Nuneaton (GB); Karim Bouras, Mülheim (DE)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/445,900

(22) Filed: Jun. 19, 2019

(65) Prior Publication Data

US 2020/0402380 A1 Dec. 24, 2020

(51) Int. Cl.

| | |
|---|---|
| ***G08B 17/06*** | (2006.01) |
| ***G08B 5/36*** | (2006.01) |
| ***G08B 3/10*** | (2006.01) |

(52) U.S. Cl.

CPC ..... *G08B 17/06* (2013.01); *G08B 3/10* (2013.01); *G08B 5/36* (2013.01)

(58) Field of Classification Search

CPC ..... G08B 17/06; G08B 3/10; G08B 5/36
USPC ..... 340/628
See application file for complete search history.

(56) References Cited

U.S. PATENT DOCUMENTS

| | | | | |
|---|---|---|---|---|
| 4,001,819 | A | 1/1977 | Wise | |
| 5,793,293 | A | 8/1998 | Melamud et al. | |
| 9,225,249 | B2 | 12/2015 | Barson | |
| 9,444,244 | B2 | 9/2016 | Hooper et al. | |
| 2004/0080401 | A1* | 4/2004 | Stewart | G08B 7/06 340/331 |
| 2010/0073175 | A1* | 3/2010 | Lontka | G08B 29/123 340/635 |
| 2010/0302045 | A1* | 12/2010 | Foster | G08B 25/06 340/577 |
| 2011/0187541 | A1* | 8/2011 | Noguchi | G10K 9/122 340/628 |
| 2013/0141245 | A1* | 6/2013 | Gadonniex | G08B 5/38 340/693.3 |
| 2015/0214842 | A1* | 7/2015 | Barson | H05B 45/37 340/538.11 |
| 2016/0035201 | A1* | 2/2016 | Savage, Jr. | G08B 17/06 340/815.45 |
| 2018/0276982 | A1* | 9/2018 | Barrieau | G08B 29/181 |
| 2019/0103755 | A1 | 4/2019 | Seberger et al. | |

FOREIGN PATENT DOCUMENTS

| | | |
|---|---|---|
| EP | 2595277 | 5/2013 |
| EP | 2701132 A1 | 2/2014 |
| WO | 2018056173 A1 | 3/2018 |

OTHER PUBLICATIONS

Extended European Search Report for related EP Application No. 20180642.9, dated Nov. 26, 2020 (9 pgs).

* cited by examiner

*Primary Examiner* — Hirdepal Singh
(74) *Attorney, Agent, or Firm* — Brooks, Cameron & Huebsch, PLLC

(57) ABSTRACT

An alarm device for a fire alarm system is described herein. One device includes at least one of an audio notification mechanism and a visual notification mechanism, a supercapacitor, and a controller configured to allow the supercapacitor to power the at least one of the audio notification mechanism and the visual notification mechanism upon a short circuit fault occurring on a loop of the fire alarm system while the alarm device is in an alarm state.

17 Claims, 4 Drawing Sheets

ALARM DEVICE FOR A FIRE ALARM SYSTEM

TECHNICAL FIELD

The present disclosure relates generally to an alarm device for a fire alarm system.

BACKGROUND

A fire alarm system can include a number of devices (e.g., alarm devices) that can detect, and/or provide a warning, when smoke, fire, and/or carbon monoxide, among other emergency situations, are present in a facility. Such warnings may be audio and/or visual warnings, for example.

A fire alarm system may be addressable. An addressable fire alarm system may utilize signaling line circuits (SLCs), which commonly may be referred to as "loops". A loop can include a control panel and a number of fire alarm system devices including, for example, alarm devices, as well as other detectors, call points, and/or interfaces. The control panel can provide power to the devices of the loop, and bi-directional communications can take place between the control panel and the devices of the loop.

During operation of the fire alarm system, faults, such as, for instance, short circuit faults, may occur on the loop (e.g., on the wiring of the loop). The devices of the loop may provide protection against short circuit faults occurring on the loop by automatically isolating the short circuit fault in conjunction with the control panel.

During this isolation process, however, no power is available to the devices of the loop from the control panel until the short circuit fault is isolated. Accordingly, in standard fire alarm systems, if a short circuit fault occurs on the loop during an alarm state, then all the alarm devices of the loop must turn off and stop providing their warning until the fault is isolated and power is once again available from the control panel. If it takes too long to isolate the fault, the alarm devices may remain off for a longer amount of time than permitted by regulatory standards.

DETAILED DESCRIPTION

Figure 1:
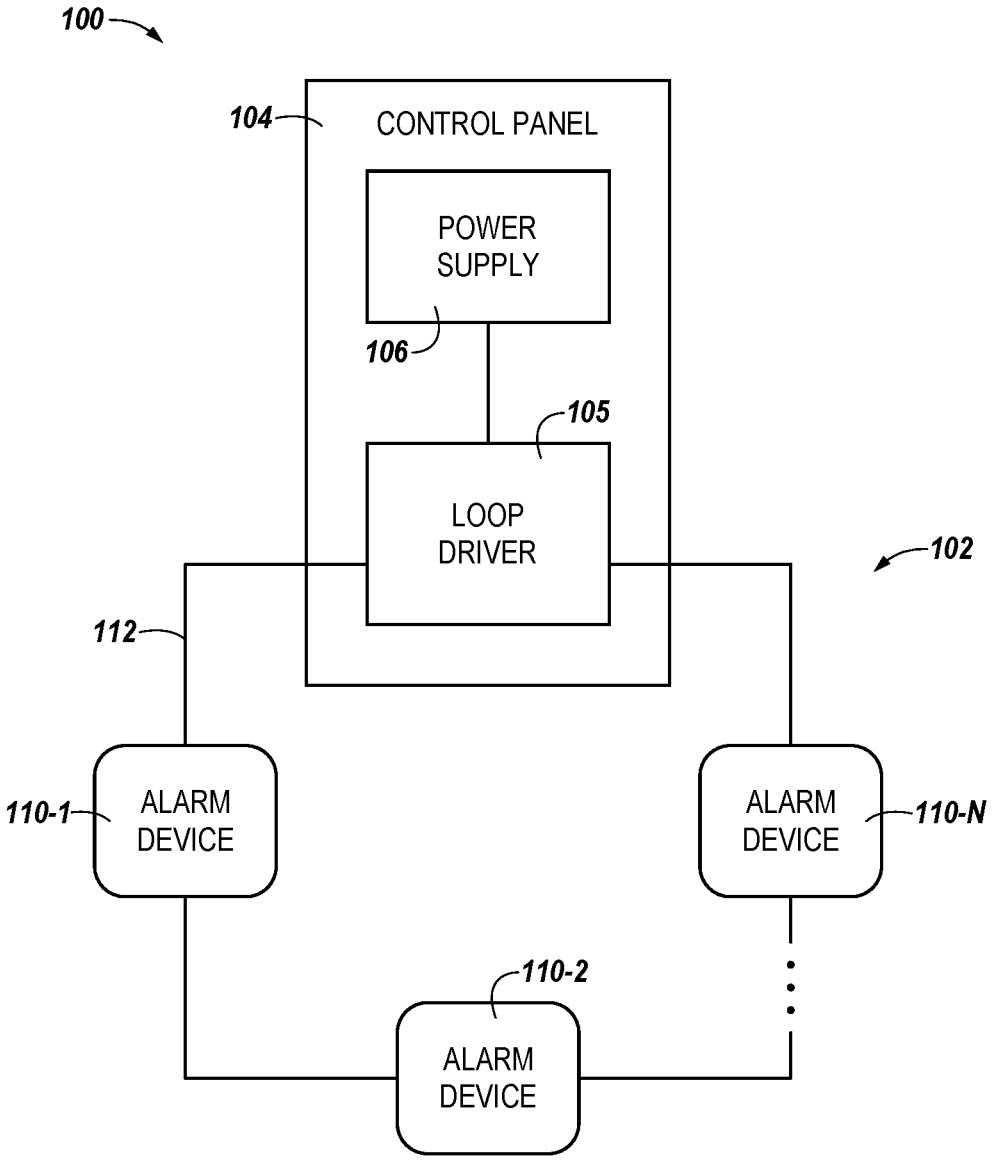
FIG. 1 illustrates an example of a fire alarm system in accordance with an embodiment of the present disclosure.

An alarm device for a fire alarm system is described herein. For example, an embodiment includes at least one of an audio notification mechanism and a visual notification mechanism, a supercapacitor, and a controller configured to allow the supercapacitor to power the at least one of the audio notification mechanism and the visual notification mechanism upon a short circuit fault occurring on a loop of the fire alarm system while the alarm device is in an alarm state.

An alarm device in accordance with the present disclosure can, during an alarm state, continue to provide its warning (e.g., an audio and/or visual warning) throughout the process of isolating a short circuit fault occurring on the loop of the fire alarm system, even though no power may be available to the alarm device from the control panel of the fire alarm system while the fault is being isolated. Accordingly, an alarm device in accordance with the present disclosure can continue to make the occupants of a facility aware of an emergency situation occurring in the facility throughout the process of isolating the short circuit fault, and can remain in compliance with regulatory standards.

Further, the capability of an alarm device in accordance with the present disclosure to continue to provide its warning throughout the short circuit fault isolation process can be more effective than that of previous alarm devices. For instance, previous alarm devices may include a secondary, rechargeable battery that may only be able to provide a portion of the power needed for the alarm device to continue to provide its warning in the absence of power from the control panel. Further, such a rechargeable battery may have a limited lifetime, a limited working temperature range, a significant charge time, and/or a significant output impedance. Further, the charge capacity of the battery may be considered to be part of the total standby capacity of the fire alarm system, which may cause the alarm device to not be compliant with testing requirements of fire alarm device and/or system regulatory standards.

In contrast, an alarm device in accordance with the present disclosure includes a supercapacitor that can provide the large, instantaneous power output needed for the alarm device to continue to provide its full warning in the absence of power from the control panel. Further, the supercapacitor may have a longer lifetime, greater working temperature range, shorter charge time, and less output impedance than the rechargeable batteries of previous alarm devices. Further, alarm devices utilizing such a supercapacitor may remain compliant with testing requirements of fire alarm device and/or system regulatory standards.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 112 may reference element "12" in FIG. 1, and a similar element may be referenced as 212 in FIG. 2.

As used herein, "a", "an", or "a number of" something can refer to one or more such things, while "a plurality of" something can refer to more than one such things. For example, "a number of devices" can refer to one or more devices, while "a plurality of devices" can refer to more than one device. Additionally, the designators "N" and "M" as used herein, particularly with respect to reference numerals in the drawings, indicate that a number of the particular feature so designated can be included with a number of embodiments of the present disclosure. This number may be the same or different between designations.

FIG. 1 illustrates an example of a fire alarm system 100 in accordance with an embodiment of the present disclosure. Fire alarm system 100 can be, for example, the fire alarm system of a facility (e.g., building).

As shown in FIG. 1, fire alarm system 100 can include a control panel 104 that includes a loop driver 105, and a power supply 106. Control panel 104 can be, for example, an addressable fire alarm control panel. Power supply 106 can be, for example, a direct current (DC) voltage source with modulation. However, embodiments of the present disclosure are not limited to a particular type of power supply. Loop driver 105 can allow data to be exchanged between loop 102 (discussed further below) and control panel 104.

Operations of power supply 106 and/or loop driver 105 can be controlled by control panel 104. In some embodiments, fire alarm system 100 can use combined power transmission and digital communications on a screened (e.g., shielded) two-wire loop. In some embodiments, fire alarm system 100 can use combined power transmission and digital communications on an unshielded cable.

As shown in FIG. 1, fire alarm system 100 can include a number of alarm devices 110-1, 110-2, . . . , 110-N. Alarm devices 110-1, 110-2, . . . , 110-N can be devices that can detect, and/or provide a notification (e.g., warning), when smoke, fire, and/or carbon monoxide, among other emergency situations, are present in the facility, in order to alert the occupants of the facility to evacuate or take some other action.

For instance, alarm devices 110-1, 110-2, . . . , 110-N can each include an audio notification mechanism, such as a speaker, sounder, or siren (e.g., the warning provided by the device can be and/or include an audio warning), and/or a visual notification mechanism, such as a display, light, sign, or strobe (e.g., the warning provided by the device can be and/or include a visual warning). Further, alarm devices 110-1, 110-2, . . . , 110-N can each include a supercapacitor that can be used to continue to power the audio and/or visual notification mechanism(s) of the alarm device throughout the process of isolating a short circuit fault occurring on the loop 102, even though no power may be available to the alarm device from control panel 104 while the fault is being isolated. An example of alarm devices 110-1, 110-2, . . . , 110-N will be further described herein (e.g., in connection with FIG. 2).

As shown in FIG. 1, alarm devices 110-1, 110-2, . . . , 110-N and control panel 104 can be communicatively coupled by wiring 112 to form an addressable loop 102. Wiring 112 can carry combined power transmission and digital communications between alarm devices 110-1, 110-2, . . . , 110-N and control panel 104. For example, control panel 104 can control the operations of, and exchange data with, alarm devices 110-1, 110-2, . . . , 110-N, via wiring 112, and can provide power from power supply 106 to alarm devices 110-1, 110-2, . . . , 110-N via wiring 112. The length of loop 102 can be, for instance, greater than or equal to two kilometers.

Although not shown in FIG. 1 for clarity and so as not to obscure embodiments of the present disclosure, loop 102 can include other devices in additional to alarm device 110-1, 110-2, . . . , 110-N. For example, loop 102 can include a number of sensor devices, such as heat detectors, smoke detectors, flame detectors, fire gas detectors, water flow detectors, among other types of sensor devices. As an additional example, loop 102 can include a number of initiating devices (e.g., fire alarm boxes), pull stations, break glass stations, and/or call points, among others.

Figure 2:
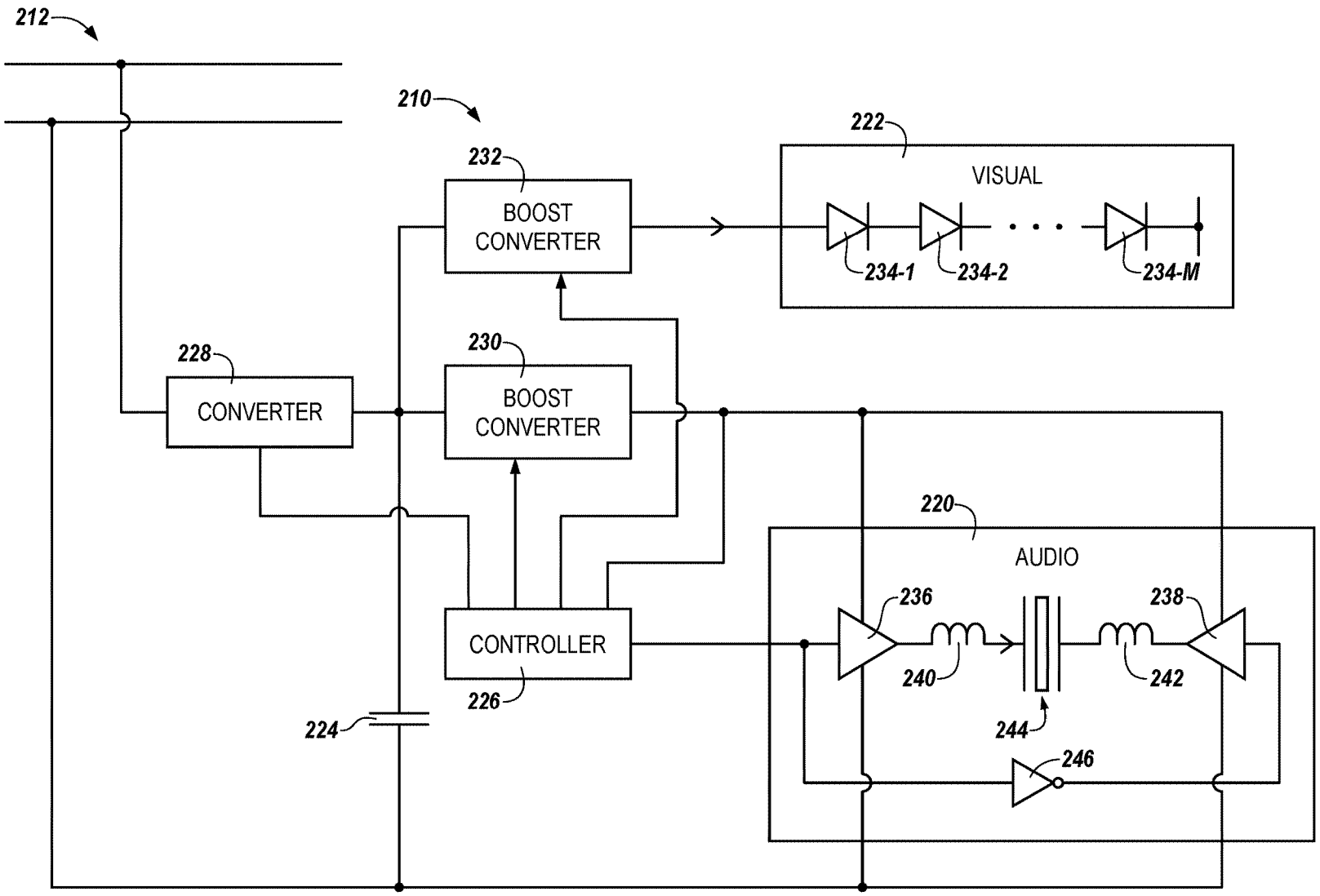
FIG. 2 illustrates an example of an alarm device for a fire alarm system in accordance with an embodiment of the present disclosure.

FIG. 2 illustrates an example of an alarm device 210 for a fire alarm system in accordance with an embodiment of the present disclosure. Alarm device 210 can be, for instance, an example of alarm devices 110-1, 110-2, . . . , 110-N of fire alarm system 100 previously described in connection with FIG. 1. For instance, as illustrated in FIG. 2, alarm device 210 can be coupled to wiring 212, and can be part of an addressable, two-wire loop of the fire alarm system (e.g., loop 102 previously described in connection with FIG. 1).

As shown in FIG. 2, alarm device 210 can include an audio notification mechanism 220 and/or a visual notification mechanism 222 that can provide a notification (e.g., warning) while alarm device 210 is in an alarm state (e.g., upon one or more devices of the fire alarm system detecting smoke, fire, carbon monoxide, or another emergency situation). In the example illustrated in FIG. 2, visual notification mechanism 222 is a strobe that includes a number of light-emitting diodes (LEDs) 234-1, 234-2, . . . , 234-M connected in series. However, embodiments of the present disclosure are not limited to a particular type of visual notification mechanism.

In the example illustrated in FIG. 2, audio notification mechanism 220 is a piezoelectric sounder (e.g., a piezo-sounder) that can provide multiple alarm tones and a voice message. For instance, audio notification mechanism 220 can be a class-D amplifier that includes a piezoelectric transducer 244, along with half-bridge drivers 236 and 238, inductors 240 and 242, and inverter 246 in the circuit arrangement illustrated in FIG. 2. However, embodiments of the present disclosure are not limited to a particular type of audio notification mechanism.

As shown in FIG. 2, alarm device 210 can include a supercapacitor 224. Supercapacitor 224 can be charged from converter 228, which is connected to wiring 212 (e.g., to one wire of the two-wire loop of the fire alarm system), as illustrated in FIG. 2.

As shown in FIG. 2, alarm device 210 can include a controller 226. Controller 226 can be, for instance, an interface circuit, a microcontroller and a memory (not shown in FIG. 2 for clarity and so as not to obscure embodiments of the present disclosure). The memory can be any type of storage medium that can be accessed by the microcontroller to perform various examples of the present disclosure. For example, the memory can be a non-transitory computer readable medium having computer readable instructions (e.g., computer program instructions) stored thereon that are executable by the microcontroller to perform various examples of the present disclosure. That is, the microcontroller can execute the executable instructions stored in the memory to perform various examples of the present disclosure.

The memory can be volatile or nonvolatile memory. The memory can also be removable (e.g., portable) memory, or non-removable (e.g., internal) memory. For example, the memory can be random access memory (RAM) (e.g., dynamic random access memory (DRAM), resistive random access memory (RRAM), and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

As an example, an external flash memory can be used to store the voice message(s) of alarm device 210, and controller 226 (e.g., the microcontroller) can include a flash memory with a portion for configuration data. However, embodiments are not limited to this example.

As an example, upon a short circuit fault occurring on the loop of the fire alarm system (e.g. on wiring 212) while alarm device 210 is in an alarm state, controller 226 can allow supercapacitor 224 to power (e.g., provide power to operate) audio notification mechanism 220 and/or visual notification mechanism 222, such that audio notification mechanism 220 and/or visual notification mechanism 222 can continue to provide their respective warnings even though no power may be available to alarm device 210 from wiring 212 due to the short circuit fault. For instance, supercapacitor 224 can provide a large instantaneous output pulse current to the audio notification mechanism 220 and/or visual notification mechanism 222. Further, as shown in FIG. 2, alarm device 210 can include boost converter 230 that can amplify (e.g., boost) the voltage provided to audio notification mechanism 220, and/or boost converter 232 that can amplify the voltage provided to visual notification mechanism 222.

For example, while alarm device 210 is in a quiescent (e.g. non-alarm) state (e.g., before the fire alarm system has detected an emergency situation), controller 226 can operate converter 228 to charge supercapacitor 224, using power provided from the loop of the fire alarm system (e.g., from wiring 212). However, to extend the working lifetime of supercapacitor 224, the supercapacitor may be less than fully charged (e.g., may not be fully charged to its maximum voltage) while alarm device 210 is in the quiescent state. For instance, supercapacitor 224 may be only 75% charged while alarm device 210 is in the quiescent state.

Upon alarm device 210 changing from the quiescent state to the alarm state (e.g., upon the fire alarm system detecting the emergency situation, but prior to the short circuit fault occurring), controller 226 can operate converter 228 to fully charge supercapacitor 224 to its maximum voltage. For example, as shown in FIG. 2, alarm device 210 can include converter (e.g., switch-mode converter) 228 that can act as a constant direct current (DC) source, and controller 226 can operate converter 228 to charge supercapacitor 224 at a constant rate. For instance, controller 226 can operate converter 228 to charge supercapacitor 224 to the average level needed to power (e.g., the average voltage level needed to operate) audio notification mechanism 220 and/or visual notification mechanism 222 prior to the short circuit fault occurring.

Further, upon alarm device 210 changing from the quiescent state to the alarm state (e.g., while supercapacitor 224 is charging to its maximum voltage), audio notification mechanism 220 and/or visual notification mechanism 222 can be powered with the power provided by the loop of the fire alarm system (e.g., by wiring 212). For instance, audio notification mechanism 220 and/or visual notification mechanism 222 can be soft-started (e.g., the power provided to audio notification mechanism 220 and/or visual notification mechanism 222 can be slowly ramped up to their maximum levels), so that alarm device 210 does not draw an excessive in-rush of current. Once supercapacitor 224 has fully charged, the power provided to audio notification mechanism 220 and/or visual notification mechanism 222 can be at their maximum levels.

Upon the short circuit fault occurring on the loop of the fire alarm system while alarm device 210 is in the alarm state, controller 226 can allow supercapacitor 224 to discharge in order to power audio notification mechanism 220 and/or visual notification mechanism 222. As such, audio notification mechanism 220 and/or visual notification mechanism 222 can continue to maintain their full output notification levels during the short circuit fault, even though no power is being provided to alarm device 210 by the loop of the fire alarm system.

Upon isolation of the short circuit fault (e.g., by the control panel of the fire alarm system), the control panel of the fire alarm system can restore power to the loop of the fire alarm system such that alarm device 210 is once again being powered by wiring 212 during the alarm state. Accordingly, controller 226 can re-charge supercapacitor 224 (e.g. using converter 228) to restore the power used to power audio notification mechanism 220 and/or visual notification mechanism 222 during the short circuit fault (e.g., while the short circuit fault was being isolated). While supercapacitor 224 is recharging, audio notification mechanism 220 and/or visual notification mechanism 222 can be powered at their maximum levels, without drawing significantly more current from wiring 212. Upon the alarm state ending, alarm device 210 can return to the quiescent state.

Figure 3:
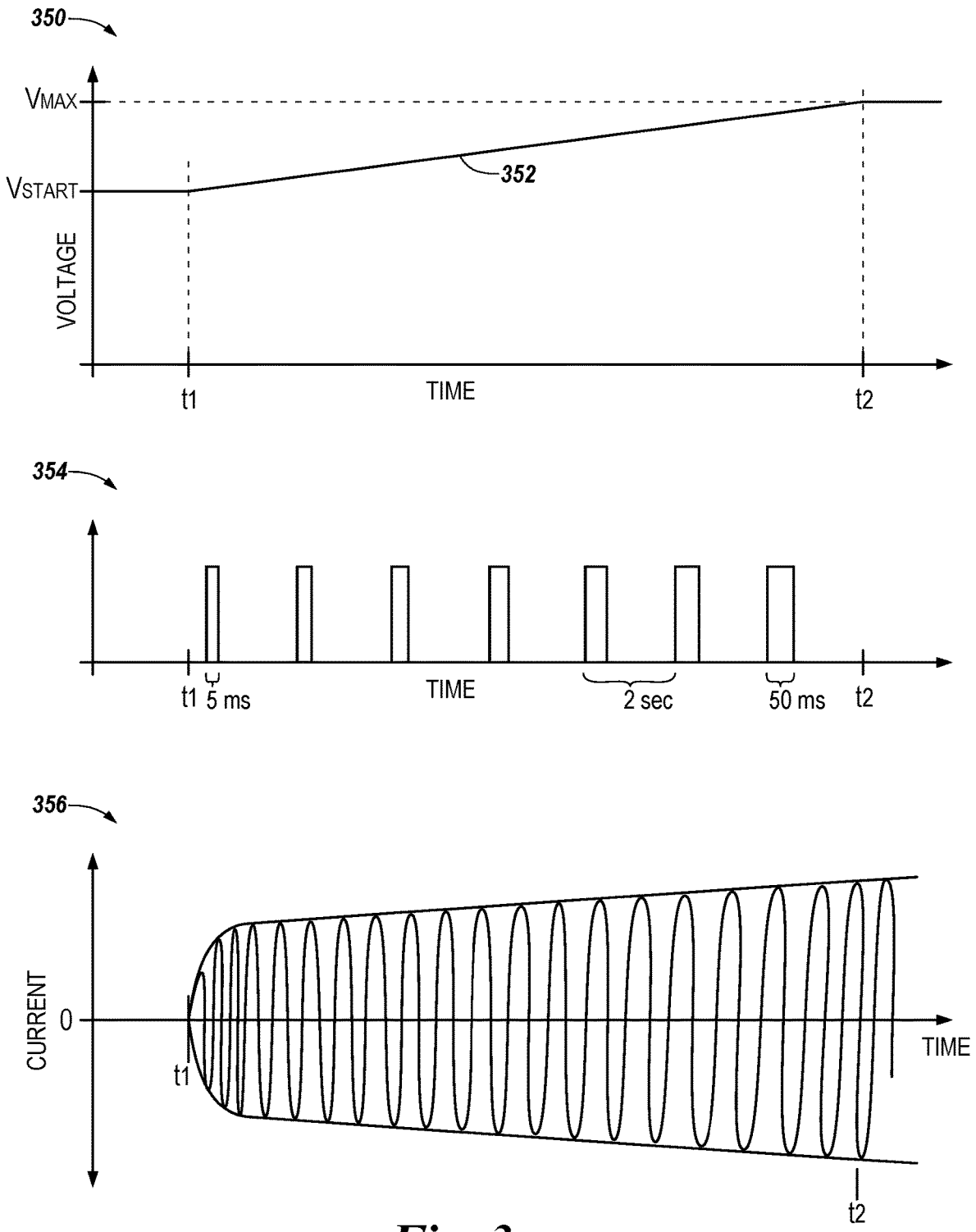
FIG. 3 illustrates example voltage and current plots associated with the operation of an alarm device for a fire alarm system in accordance with an embodiment of the present disclosure.

FIG. 3 illustrates example voltage and current plots (e.g., graphs) associated with the operation of an alarm device for a fire alarm system in accordance with an embodiment of the present disclosure. For example, plot 350 illustrates an example voltage level 352 of the supercapacitor of the alarm device, plot 354 illustrates an example of the current provided to the visual notification mechanism, and plot 356 illustrates an example of the current provided to the audio notification mechanism. The fire alarm system can be, for example, fire alarm system 100 previously described in connection with FIG. 1, the alarm device can be, for example, alarm devices 110-1, 110-2, . . . , 110-N previously described in connection with FIG. 1 and/or alarm device 210 previously described in connection with FIG. 2, and the supercapacitor, visual notification mechanism, and audio notification mechanism can be, for example, supercapacitor 224, visual notification mechanism 222, and audio notification mechanism 220, respectively, previously described in connection with FIG. 2.

In the examples illustrated in FIG. 3, the alarm device changes from a quiescent state to an alarm state at time t1, and soft-starts the alarm output between time t1 and time t2 (e.g., the alarm device is in the quiescent state before time t1, and is in the full alarm state from time t2). As illustrated in plot 350, before time t1, the voltage level 352 of the supercapacitor of the alarm device is at a starting level ($V_{START}$) that is less than the maximum voltage level ($V_{MAX}$) of the supercapacitor, in order to extend the working lifetime of the supercapacitor, as previously described herein (e.g., in connection with FIG. 2). For instance, the starting voltage level of the supercapacitor may be 75% of its maximum voltage level. Further, as illustrated in plots 354 and 356, before time t1, no current is provided to the visual or audio notification mechanisms.

As illustrated in plot 350, at time t1, the voltage level 352 of the supercapacitor begins to increase (e.g., because the supercapacitor begins to fully charge, as previously described herein), and the voltage level 352 continues to increase until it reaches the maximum voltage level of the capacitor at time t2. In the example illustrated in plot 350, the voltage level 352 increases at a constant rate.

Further, as illustrated in plots 354 and 356, at time t1, current begins to be provided to the visual and audio notification mechanisms. For instance, current is supplied to the visual notification mechanism 222 in direct current (DC) pulses, as shown in plot 354. Also, current is supplied to the piezoelectric transducer 224 of the audio notification mechanism as an alternating current (AC), as shown in plot 356. At time t2, the current has reached its maximum value in the visual and audio notification mechanisms, as illustrated in FIG. 3.

As illustrated in plots 354 and 356, the current pulses supplied to the visual and audio notification mechanisms can be slowly ramped up after time t1, so that the alarm device does not draw an excessive in-rush of current, as previously described herein (e.g., in connection with FIG. 2). For instance, the amount of time for which each respective DC pulse is supplied to the visual notification mechanism (e.g., the width of the DC pluses) can increase from 5 milliseconds (mS) to 50 mS, while the amount of time between the start of each respective DC pulse can remain the same (e.g., 2 seconds), as shown in plot 354. Further, the amplitude of the respective AC current used by the audio notification mechanism can increase to a maximum value, as shown in plot 356. Although the AC current is shown in FIG. 3 as a fixed frequency (e.g., a fixed tone), embodiments of the present disclosure are not so limited (e.g., the AC current could be any number of complex frequencies with complex timings).

Figure 4:
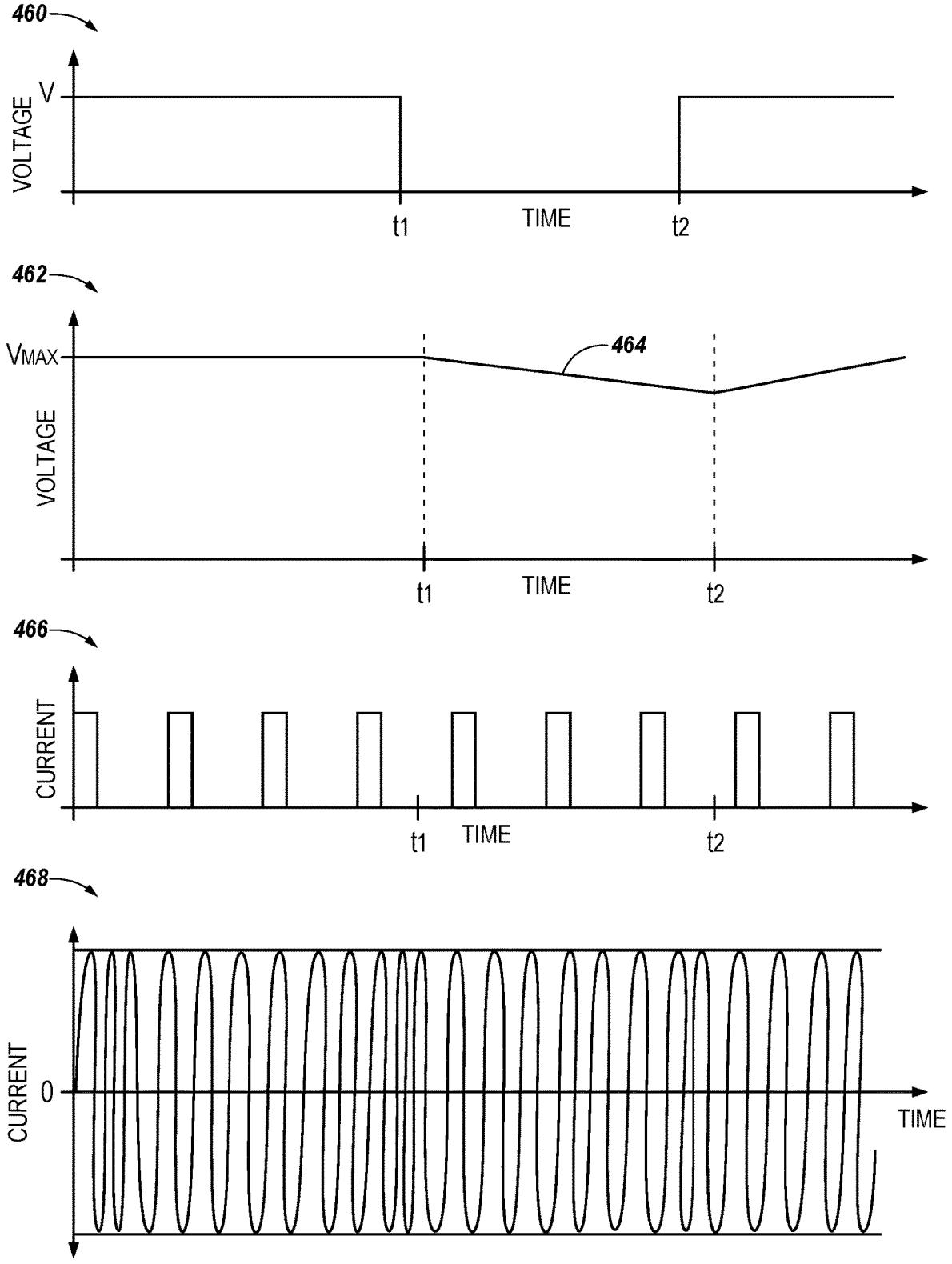
FIG. 4 illustrates example voltage and current plots associated with the operation of an alarm device for a fire alarm system in accordance with an embodiment of the present disclosure.

FIG. 4 illustrates example voltage and current plots (e.g., graphs) associated with the operation of an alarm device for a fire alarm system in accordance with an embodiment of the present disclosure. For example, plot 460 illustrates an example voltage level provided to the alarm device by a loop of the fire alarm system, plot 462 illustrates an example voltage level 464 of the supercapacitor of the alarm device, plot 466 illustrates an example of the current provided to the visual notification mechanism, and plot 468 illustrates an example of the current provided to the audio notification mechanism. The fire alarm system can be, for example, fire alarm system 100 previously described in connection with FIG. 1, the alarm device can be, for example, alarm devices 110-1, 110-2, . . . , 110-N previously described in connection with FIG. 1 and/or alarm device 210 previously described in connection with FIG. 2, the loop of the fire alarm system can be, for example, loop 102 previously described in connection with FIG. 1, and the supercapacitor, visual notification mechanism, and audio notification mechanism can be, for example, supercapacitor 224, visual notification mechanism 222, and audio notification mechanism 220, respectively, previously described in connection with FIG. 2.

In the examples illustrated in FIG. 4, the alarm device is in an alarm state, and a short circuit fault is occurring on the loop of the fire alarm system from time t1 to time t2 (e.g., the short circuit fault begins at time t1, and is isolated at time t2). Before time t1, a voltage level V is provided to the alarm device by the loop of the fire alarm system, as shown in plot 460, and the voltage level 464 of the supercapacitor of the alarm device is at the maximum voltage level ($V_{MAX}$) of the supercapacitor.

Further, before time t1, current is provided to the visual and audio notification mechanisms, as shown in plots 466 and 468. For instance, current is supplied to the visual notification mechanism in DC pulses, as shown in plot 466, and current is supplied to the piezoelectric transducer of the audio notification mechanism as AC, as shown in plot 468. The current may be supplied to the visual and audio notification mechanisms before time t1 from the voltage provided to the alarm device by the loop of the fire system, as previously described herein (e.g., in connection with FIG. 2).

At time t1, the voltage level provided to the alarm device by the loop of the fire alarm system drops to zero, and no voltage is provided to the alarm device by the loop from time t1 to t2, as shown in plot 460 (e.g., because of the short circuit fault, as previously described herein). Further, at time t1, the voltage level 464 of the supercapacitor of the alarm device begins to decrease (e.g., because the supercapacitor begins to discharge to power the visual and audio notification mechanisms in the absence of voltage being provided from the fire alarm system loop, as previously described herein), as shown in plot 462.

Accordingly, from time t1 to t2, current can continue to be supplied to the visual and audio notification mechanisms, as shown in plots 466 and 468, respectively, even though no voltage is being provided to the alarm device by the loop. For instance, the current can continue to be supplied to the visual notification mechanism in DC pulses, as shown in plot 466, and the current can continue to be supplied to the audio notification mechanism as AC, as shown in plot 468.

At time t2, the voltage level provided to the alarm device by the loop of the fire alarm system returns to V, as shown in plot 460 (e.g., because the short circuit fault has been isolated, as previously described herein). Accordingly, after time t2, the current supplied to the visual and audio notification mechanisms, as shown in plots 466 and 468, respectively, can once again be provided from the voltage provided to the alarm device by the loop. For instance, the current can be supplied to the visual notification mechanism in DC pulses, as shown in plot 466, and the current can continue to be supplied to the audio notification mechanism as AC, as shown in plot 468.

Further, after time t2, the voltage level 464 of the supercapacitor begins to increase (e.g., because the supercapacitor begins to re-charge after the voltage provided by the loop of the fire alarm system is restored, as previously described herein), as shown in plot 462. In the example illustrated in plot 462, the voltage level 464 increases at a constant rate.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. An alarm device for a fire alarm system, comprising:

at least one of an audio notification mechanism and a visual notification mechanism;

a supercapacitor; and a controller configured to:

allow the supercapacitor to power the at least one of the audio notification mechanism and the visual notification mechanism upon a short circuit fault occurring on a loop of the fire alarm system while the alarm device is in an alarm state; and allow the supercapacitor to charge to an average level needed to power the at least one of the audio notification mechanism and visual notification mechanism while the alarm device is in the alarm state prior to the short circuit fault occurring.

2. The alarm device of claim 1, wherein:

the alarm device includes a converter configured to act as a direct current (DC) source; and the controller is configured to operate the converter to charge the supercapacitor while the alarm device is in the alarm state prior to the short circuit fault occurring.

3. The alarm device of claim 1, wherein the controller is configured to allow the supercapacitor to discharge to power the at least one of the audio notification mechanism and the visual notification mechanism upon the short circuit fault occurring.

4. The alarm device of claim 1, wherein the controller is configured to allow the supercapacitor to charge to less than a fully charged level while the alarm device is in a quiescent state.

5. A method for operating an alarm device of a fire alarm system, comprising:

operating a supercapacitor of the alarm device such that:

the supercapacitor charges while the alarm device is in an alarm state;

the supercapacitor charges to less than a fully charged level while the alarm device is in a quiescent state; and the supercapacitor powers at least one of an audio notification mechanism and a visual notification mechanism of the alarm device upon a short circuit fault occurring on a loop of the fire alarm system while the alarm device is in the alarm state.

6. The method of claim 5, wherein the supercapacitor powers the at least one of the audio notification mechanism and the visual notification mechanism upon the short circuit fault occurring by providing current to the at least one of the audio notification mechanism and the visual notification mechanism.

7. The method of claim 6, wherein the method includes amplifying a voltage provided to the at least one of the audio notification mechanism and the visual notification mechanism.

8. The method of claim 5, wherein the method includes operating the supercapacitor such that the supercapacitor re-charges while the alarm device is in the alarm state upon isolation of the short circuit fault.

9. The method of claim 5, wherein the method includes powering the at least one of the audio notification mechanism and the visual notification mechanism with power provided by the loop of the fire alarm system while the supercapacitor charges while the alarm device is in the alarm state.

10. The method of claim 5, wherein the method includes operating the supercapacitor of the alarm device such that the supercapacitor fully charges while the alarm device is in the alarm state.

11. The method of claim 5, wherein the method includes operating the supercapacitor of the alarm device such that the supercapacitor charges at a constant rate while the alarm device is in the alarm state.

12. A fire alarm system, comprising:

a plurality of alarm devices wired in a loop, wherein each respective one of the plurality of alarm devices includes:

an audio notification mechanism;

a visual notification mechanism;

a supercapacitor; and a controller configured to allow the supercapacitor to power the audio notification mechanism and the visual notification mechanism upon a short circuit fault occurring on the loop while the fire alarm system is in an alarm state;

a loop driver; and a control panel configured to operate the loop driver to exchange data with the plurality of alarm devices in the loop.

13. The fire alarm system of claim 12, wherein the audio notification mechanism of each respective one of the plurality of alarm devices comprises a piezoelectric sounder.

14. The fire alarm system of claim 12, wherein the visual notification mechanism of each respective one of the plurality of alarm devices comprises a number of light-emitting diodes.

15. The fire alarm system of claim 12, wherein the loop in which the plurality of alarm devices are wired is an addressable loop.

16. The fire alarm system of claim 12, wherein a length of the loop in which the plurality of alarm devices are wired is greater than or equal to two kilometers.

17. The fire alarm system of claim 12, wherein the fire alarm system includes:

a power supply; and the control panel is configured to operate the power supply to provide power to the plurality of alarm devices in the loop.

* * * * *